US005627571A

United States Patent [19]

Anderson et al.

[11] Patent Number: 5,627,571

[45] Date of Patent: May 6, 1997

[54] DROP SENSING AND RECOVERY SYSTEM FOR AN INK JET PRINTER

[75] Inventors: David G. Anderson; Alfred J. Claflin, both of Ontario; Fred F. Hubble, III; James P. Martin, both of Rochester, all of N.Y.

[73] Assignee: Xerox Corporation, Stamford, Conn.

[21] Appl. No.: 322,129

[22] Filed: Oct. 13, 1994

[51] Int. Cl.[6] ..... B41J 29/393

[52] U.S. Cl. ..... 347/19; 347/23; 347/42

[58] Field of Search ..... 347/12, 13, 19, 347/23, 28, 42

[56] References Cited

U.S. PATENT DOCUMENTS

| | | | |
|---|---|---|---|
| 4,489,335 | 12/1984 | Watanabe et al. | 347/23 |
| 4,814,794 | 3/1989 | Sato | 347/28 |
| 4,977,459 | 12/1990 | Ebinuma et al. | 358/296 |
| 5,117,244 | 5/1992 | Yu | 346/140 R |
| 5,198,054 | 3/1993 | Drake et al. | 156/64 |
| 5,250,962 | 10/1993 | Fisher et al. | 346/140 R |
| 5,304,814 | 4/1994 | Markham | 250/573 |
| 5,434,430 | 7/1995 | Stewart | 250/573 |

FOREIGN PATENT DOCUMENTS

| | | | |
|---|---|---|---|
| 63-221050 | 9/1988 | Japan | 347/19 |

*Primary Examiner*—Benjamin R. Fuller
*Assistant Examiner*—Craig A. Hallacher

[57] ABSTRACT

A maintenance system for an ink jet printer of the type having a full width array printhead has a movable carriage with a droplet sensor and a nozzle recovery device. As the carriage moves along the length of the printhead, each nozzle checked, one at a time, by the droplet sensor for the presence or absence of an ejected droplet and if the droplet has the correct directionality. Any problem nozzle is identified during a single traversal of the carriage across the printhead, and during a second traversal, the identified problem nozzles have a recovery operation performed on them such as being cleaned to remove any dried ink or other contaminating particles or being primed in the case of a clogged nozzle. The problem nozzles which have had a recovery operation performed on them and checked again by the droplet sensor is required for the entire array of nozzles, and ink is conserved since only predetermined nozzles are printed.

9 Claims, 7 Drawing Sheets

DROP SENSING AND RECOVERY SYSTEM FOR AN INK JET PRINTER

BACKGROUND OF THE INVENTION

This invention relates to ink jet printer maintenance systems and more particularly to a droplet sensing and recovery system for a full width array printhead, wherein each nozzle is checked for failure of droplet ejection or misdirectionality of ejected droplet and recovery hardware is used to return the faulty nozzle detected to proper operation.

A continuing problem with thermal ink jet printers is the drying of ink at the printhead nozzles, thus causing clogging or partially blocking the nozzles. The result of clogged nozzles is that droplets fail to be ejected or that droplets fail to follow the desired droplet trajectory to the recording medium. To overcome this, a maintenance station is commonly used whereby the printhead is capped or sealed in a high humidity environment to prevent or to greatly retard drying. Maintenance stations include the capability of exerting a vacuum to suck ink from the nozzles to clear the nozzles of dried ink or viscous plugs and to remove any air bubbles that may have accumulated or formed in the printhead. This sucking of ink by the maintenance station is generally referenced to as priming. Periodic ejection of ink droplets from the nozzles while the printhead is at the maintenance station also clears the nozzles of dried ink and viscous plugs of ink.

Full width array printheads having 300 to 600 nozzles per inch or more present unique problems for maintenance because of the large numbers of nozzles. For example, a 12 inch wide printhead having 600 nozzles per inch would employ 7200 nozzles, each of which is susceptible of drying out. It is not economically practical to re-prime all of the nozzles each time a few may become clogged, for too much ink is wasted. Many approaches have been undertaken by the prior art to maintain the operability of all of the nozzles in a full width array printhead, but none have interrogated each nozzle to detect droplet ejection and droplet directionality and address only those malfunctioning nozzles with recovery hardware, thereby conserving the consumption of ink.

U.S. Pat. No. 5,250,962 to Fisher et al. discloses a movable priming station capable of priming a portion of an extended array of nozzles at one time in an ink jet printhead by applying a vacuum to at least one nozzle located in the array. The movable priming station includes a support which is moved along the length of the nozzle array and a vacuum tube is attached to the support. One end of the tube functions as a vacuum port which confronts but is spaced from the nozzles, when the support is moved laterally along the nozzle array.

U.S. Pat. No. 5,117,244 to Yu discloses a device to cap a full width array, thermal ink jet printhead without the need of moving the printhead or the paper transport. The capping device has a resilient gasket which contains magnetic material and is attached to the printhead by a relatively thin flexible boot or sleeve. The paper transport is a belt adjacently spaced parallel to the face of the printhead containing the nozzle array. The transport belt is flat and has a steel bar disposed in sliding contact beneath the belt portion confronting the printhead. During operation of the printer, an electromagnet disposed on the printhead is energized, allowing the steel bar to attract the magnetic gasket and seal the gasket to the transport belt.

U.S. Pat. No. 5,304,814 to Markham discloses a sensor circuit and method for detecting the presence of an ink droplet ejected from an ink jet printhead. An integrator integrates the output of the sensor and a high gain amplifier amplifies the integrated signal to provide a sensor circuit output signal. When the droplet at least partially interrupts the light path, the integrated output signal indicates the presence or passage of the droplet. The circuit is preferably used to control a heating element of a thermal ink jet printhead by adjusting the power to the heating elements to assure its operation with a power adequate to eject a droplet.

SUMMARY OF THE INVENTION

It is the object of this invention to check for droplet ejection and the directionality thereof for each nozzle in an array of nozzles in a full width array printhead, one nozzle at a time by a single movable sensor, and then individually recover or correct the inadequately functioning nozzle by movable recovery hardware packaged and movable with the sensor.

In the present invention, a droplet sensing element is translated along the length of a full width array printhead to interrogate the droplet ejection performance of each printhead nozzle, one nozzle at a time. This enables the use of one sensor for the entire full width array printhead and eliminates the need to incorporate separate droplet sensors for each nozzle. The presence or absence of an ejected droplet is sensed as well as its directionality and the information is electronically stored in the printer controller. The stored location of the problem nozzles permits a recovery device, mounted on the same translatable carriage as the droplet sensor, under the control of the printer controller to address each specific problem and to perform a selected operation, such as, cleaning or priming the problem nozzle depending upon whether the nozzle failed to eject a droplet or the directionality of the droplet was incorrect, indicating the presence of contamination or dried ink in the vicinity of the nozzle. Various maintenance algorithms have been programmed in the printer controller which are selected based upon the sensor's output circuitry. The algorithms include such actions as increased dwell time for the problem nozzle, increased vacuum or priming suction, or repeated wet wipe prior to a vacuum cleaning operation to remove the liquid cleaning solution and dissolved or entrained ink or other contaminants therein. The corrected problem nozzles are checked again for proper performance after the recovery operation by the recovery device. If all nozzles are functioning properly, the printer controller enables printing by the printer. If one or more nozzles are still not ejecting a droplet or ejecting misdirected droplets, the controller resends the recovery device to the remaining problem nozzles for a programmed number of times. If all nozzles are not returned to satisfactory operation, an error signal communicated to the printer control panel to inform the printer user and the printer is disabled from a printing mode unless manually overridden by the printer operator.

The foregoing features and other objects will become apparent from a reading of the following description in conjunction with the drawings, wherein like index numerals indicate like parts.

DESCRIPTION OF THE PREFERRED EMBODIMENT

Figure 1:
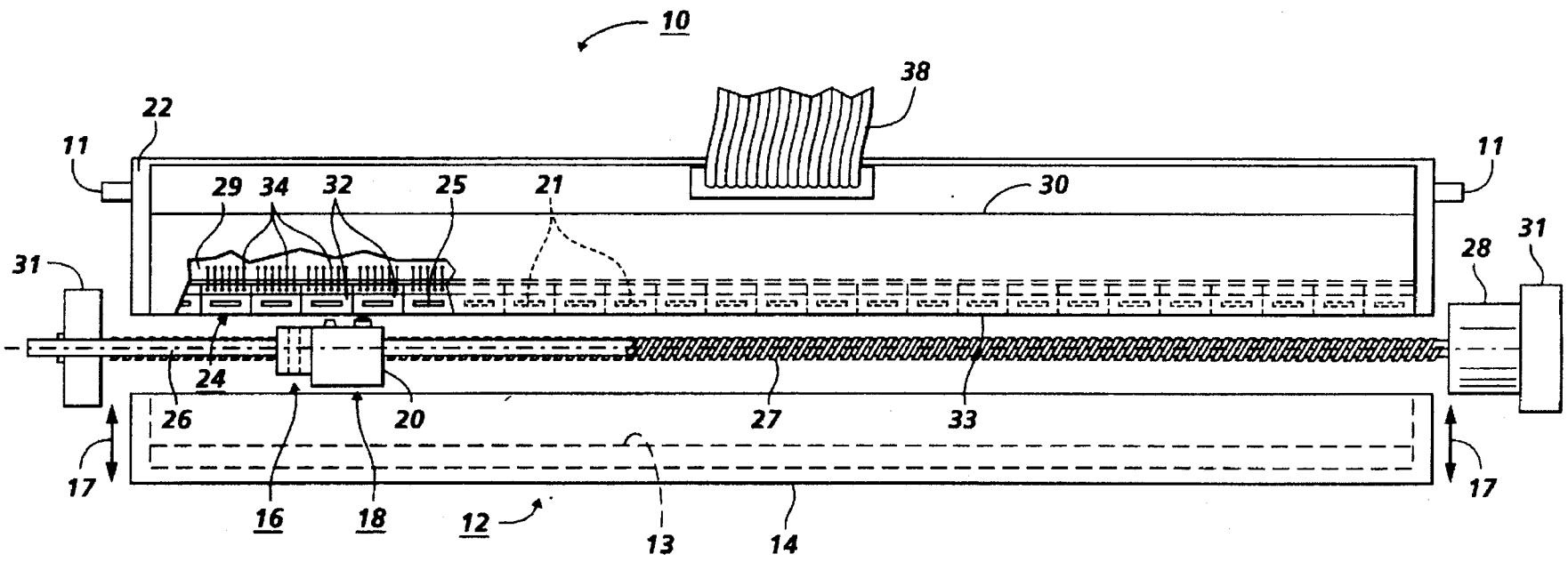
FIG. 1 is a partially shown schematic plan view of the printhead positioned in a maintenance station which includes a droplet sensor and recovery device mounted on a translatable carriage that is translated across and parallel to the nozzle face of a full width array printhead.
Figure 2:
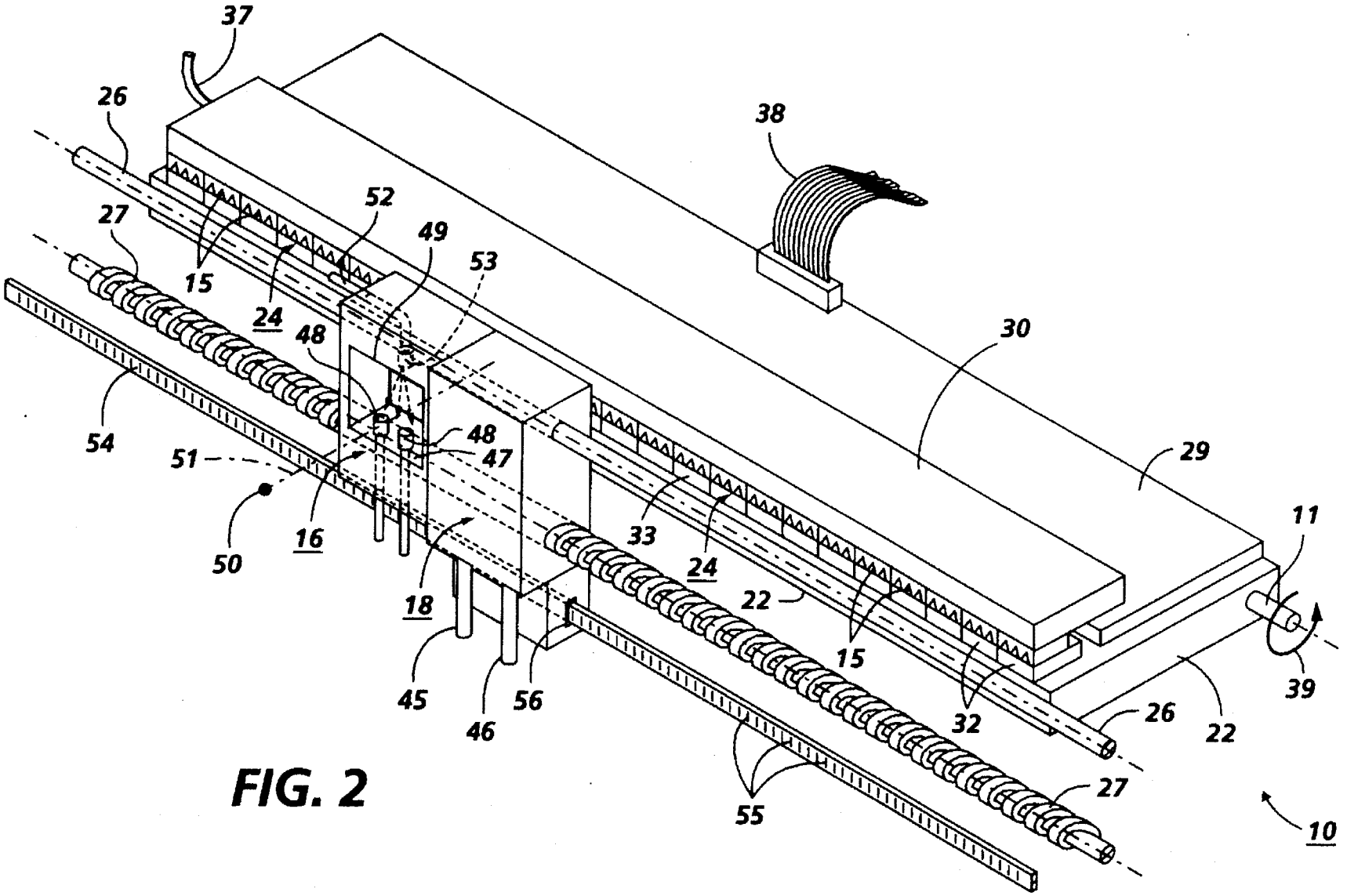
FIG. 2 is an isometric view of the full width array printhead showing the nozzle array in the nozzle face thereof, with a partially shown droplet sensor and recovery device confronting the nozzle array.

In one well known type of drop-on-demand ink jet printer (not shown), a full width array printhead 10, such as that shown in FIGS. 1 and 2, is held in a stationary position, when the printer is in the printing mode, and a recording medium (not shown), such as cut sheets of paper, is moved past the printhead at a constant velocity to receive ink droplets ejected from the printhead. The printhead has a linear array of nozzles 15 that extend completely across the width of the recovering medium. Thus, if one nozzle out of the entire array malfunctions, a streak of missing image is readily apparent in a direction parallel to the direction of movement of the printed sheet of recording medium. When the printer is not printing, the printhead is repositioned to a location confronting a maintenance station 12, as shown in FIG. 1. Here the printhead nozzles 15 may be sealed by a cap 14 to prevent drying of the ink in the nozzles or, as shown in FIG. 1, the cap may be retained in a spaced position and a recover device 18 used to correct the problem nozzles by cleaning and priming.

FIG. 1 is a partially shown, schematic plan view of the full width array printhead 10 located at a maintenance station 12, comprising a droplet sensor 16 and recovery device 18, integrally mounted on a translatable carriage 20, and a movable cap 14. The cap 14 is shown spaced from the printhead 10, but may be actuated by any suitable means (not shown) such as, for example, a solenoid, to move the cap into and out of sealing contact with the nozzle face 33 of the printhead, as indicated by when the printhead is not in the printing mode. As is well known, the cap provides an air tight chamber, when sealed around the array of nozzles 15 (seen only in FIG. 2) in the printhead face, and the sealed chamber is generally humidified to provide a moist atmosphere which prevents the ink in the nozzles from drying out. The humidity in the cap may be provided in several known ways, such as, by absorbent pad 13, shown in dashed line, which may be filled with ink or other liquid. One known way to fill the absorbent pad is by ejection of ink droplets into it from the printhead nozzles, and another is by way of a separate liquid supply (not shown). In order to cap the printhead nozzles when the printhead is not printing, the printhead must be moved to another location away from the recording medium transport means (not shown), usually a transport belt. In FIGS. 1 and 2, the printhead 10 is shown rotated away from the printing zone (not shown), where it faces the transport means, to a location adjacently confronting the translatable carriage 20. The printhead rotation is about trunnions 11 extending from the opposite ends of the mounting substrate 22 as indicated by arrows 39. The carriage 20 is translated back and forth along a guide rail 26 and rotatably driven threaded shaft 27, which are parallel to each other. The guide rail is fixedly mounted in fixed frame members 31 of the printer (not shown), and the threaded shaft is rotatably mounted in the frame members 31 and driven by electric motor 28. The guide rail and shaft are separated from each other by a distance sufficient to permit the cap to move between them, when carriage 20 is moved to one side of the printhead.

Figure 5:
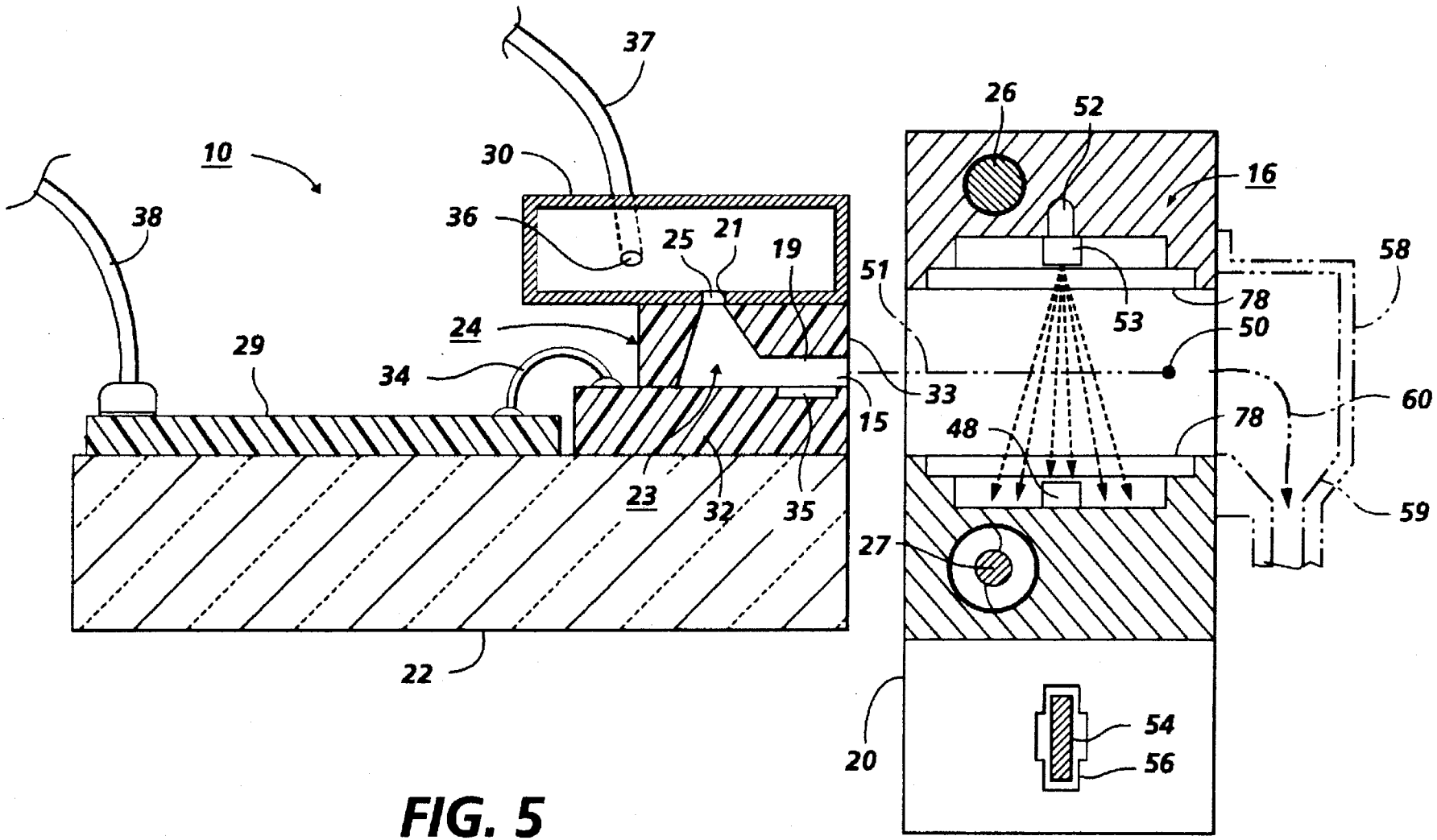
FIG. 5 is a schematic cross-sectional side view of the droplet sensor confronting a one of the nozzles of the full width array printhead as viewed along section line 5—5 of FIG. 4.

The full width array printhead 10 is assembled from printhead subunits 32 into a linear array of subunits on mounting substrate 22 as disclosed in U.S. Pat. No. 5,198,054 to Drake et al., incorporated herein by reference. The mounting substrate is preferably graphite, but may be any suitable metal such as steel or aluminum. The mounting substrate not only provides the structural integrity for mounting of the printhead 10 in the printer, but also is a means of heat management, since it readily conducts and dissipates heat. Additional cooling may be provided by the circulation of a coolant (not shown) through the mounting substrate 22. A printed circuit board 29 is bonded to the mounting substrate adjacent the subunit array by wire bonds 34. To print the required information, a printer controller (not shown) controls electrical pulses to the heating elements 35 (shown in FIG. 5), one heating element being located in each channel 19 of each subunit 32, by individually addressing each heating element via ribbon cable 38, electrodes on the circuit board 29, and wire bonds 34 to the monolithically integrated driver circuitry and logic (not shown) on each subunit 32. Referring to FIGS. 1 and 5, an ink supply manifold 30 is mounted on the side of the array 24 of printhead subunits 32, opposite the subunit sides bonded to the mounting substrate 22, and is in sealed communication with the ink inlets 25 of the subunit reservoirs 23 through aligned openings 21 in the manifold 30 to supply ink to the subunit array 24. The main ink supply (not shown) is located in the printer separately from the manifold and is connected to the manifold by hose 37 sealingly attached to the manifold inlet 36. The printhead subunits each have a linear array of parallel channels 19 in communication with the subunit 32. The individual nozzle faces of each subunit 32 is coplanar with each other to form a single nozzle face for the subunit array 24.

Periodically the full width array printhead 10 is relocated from the printing zone or location (not shown) to a position adjacent the maintenance station 12, so that each nozzle 15 may be interrogated or checked one at a time by a droplet sensor 16 for droplet ejection and, if a droplet is sensed, then the droplet trajectory is concurrently sensed for appropriate directionality. In the preferred embodiment the droplet sensor and recovery device 18 are integrally assembled in a carriage 20, which is generally positioned to one side of the printhead, thereby enabling the cap 14 to be sealed against the printhead nozzle face 33 and enclose the entire array of nozzle 15, if the nozzle array is to be capped, such as when the printer is in the non-printing or standby mode. Even if the printer is in the printing mode, the printing by the printhead is periodically interrupted and moved to the maintenance station for a short period of time so that the droplet ejection performance of each nozzle can be checked by the droplet sensor and then the printhead is returned to the printing zone to continue the printing operation. Any failure to eject a droplet or any directionality problem detected causes the printhead to remain at the maintenance station for a predetermined corrective action by the recovery device as discussed below.

Figure 4:
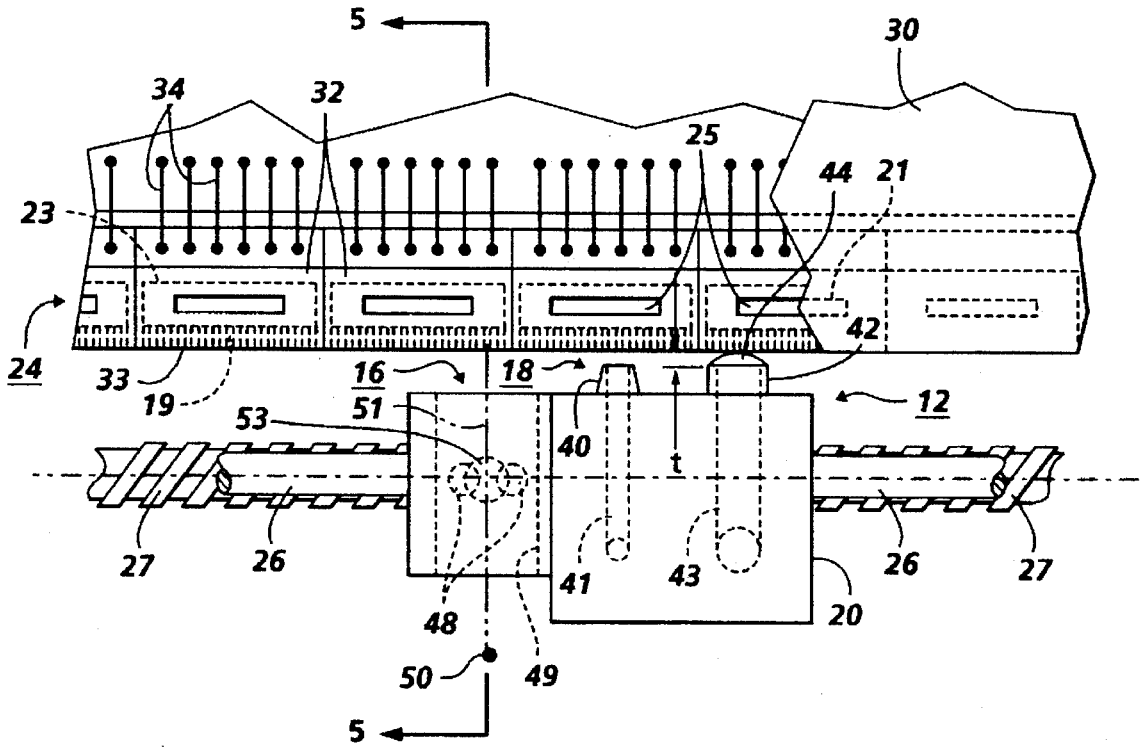
FIG. 4 is an enlarged schematic plan view of the droplet sensor and recovery device incorporated in the translatable carriage.

FIG. 4 shows an enlarged schematic plan view of the carriage 20 with integral droplet sensor 16 and recovery device 18 and a partially shown portion of the subunit array 24 with the ink supply manifold 30 partially removed for clarity. The recovery device has a vacuum nozzle 40 connected by passageway 41, shown in dashed line, to a vacuum source (not shown) by passageway 43 also shown in dashed line and hose 46 (see FIG. 2). The liquid wiper comprises a meniscus 44 of cleaning solution which selectively contacts the nozzle face 33 when the cleaning solution is slightly pressurized to cause the meniscus to bulge. The vacuum nozzle is spaced by distance "t" from the nozzle face to enable vacuum removal of the cleaning solution deposited on the nozzle face by the meniscus as the carriage 20 moves along parallel to the nozzle face. The cleaning solution dissolves or loosens and entrains dried ink and other contaminants such as dust or paper fibers, thereby enable ready vacuum removal of the cleaning solution with the dried ink and contaminants therein. When priming is necessary, the vacuum nozzle is stopped in alignment with the selected nozzle and the vacuum suction is increased by the printer controller to suck a predetermined quantity of ink from the problem nozzle. The carriage speed for droplet sensing is about 2 inches/second. The return traverse of the carriage to recover problem nozzles with the cleaning solution is about 2 inches/second for nozzles with directionality problems. The nozzles which fail to eject droplets are primed by the vacuum removal of ink. For printheads having nozzles which print at 600 spi, priming of each nozzle removes 8–13 nanoliters of ink. The problem nozzles are identified and stored in a memory unit of the printer controller and after the first recovery performance of the recovery device 18, the droplet ejection status of each identified nozzle for which recovery action was conducted is checked again by the droplet sensor 16 as described in more detail later. Any problem nozzle that is not fully corrected is again cleaned or primed by the recovery device and checked again. If after a predetermined number of recovery attempts, 3 in the preferred embodiment, the printer controller activates a display panel (not shown) which informs the printer operator that one or more nozzles cannot be cleaned and prevents printing by the printer unless a manual override is activated. The manual override enables the printing of less than optimum quality.

The ink removed by a priming operation through the vacuum nozzle and the cleaning solution removed by the vacuum nozzle are both collected in a collection and separation tank (not shown) located intermediate the vacuum source. The collection and separation tank is connected to the vacuum passageway 41 by hose 45 (FIG. 2). The supply of liquid cleaning solution is pressurized by any suitable means to apply pressure thereto to cause the meniscus to bulge, such as, from a static head height of the supply container, a cam actuated diaphragm or a piston, none of which are shown. A similar recovery device is disclosed in copending and commonly assigned U.S. patent application Ser. No. 08/047,931 filed Apr. 19, 1993, entitled "Wet-Wipe Ink Jet Printer" by Clafin et al. and is incorporated herein by reference.

Figure 3:
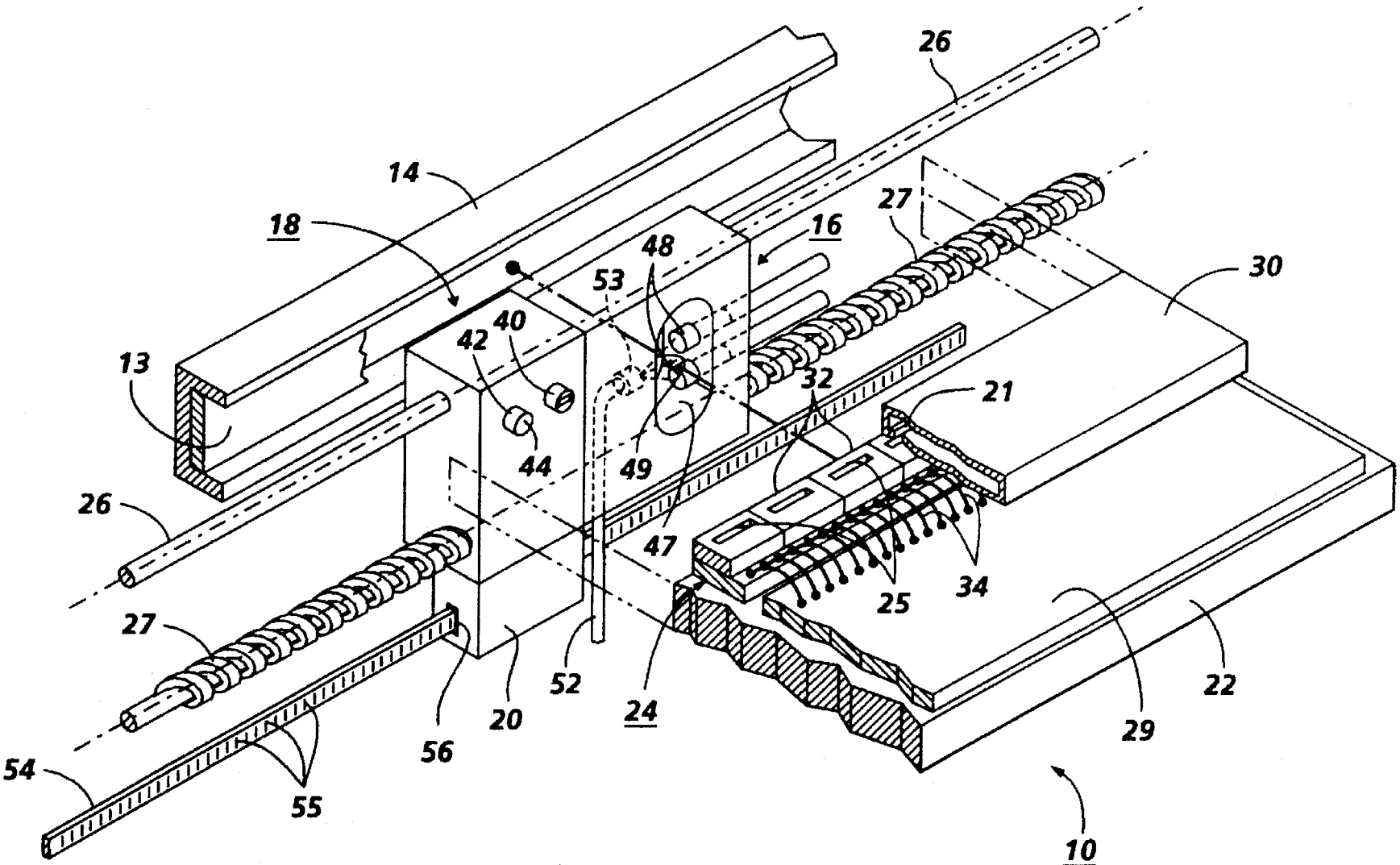
FIG. 3 is an isometric view of the droplet sensor and recovery device as they face toward the viewer and a partially shown full width array printhead as seen from the back side. An alternate orientation of the sensor is shown.

Referring to FIGS. 2 and 4, the droplet sensor 16 comprises a pair of photodetectors 48, similar to those described in U.S. Pat. No. 4,255,754 to Crean et al. and incorporated herein by reference, mounted in a wall 47 of carriage 20, which wall defines an opening 49 through which ejected droplets 50 pass along trajectory 51. Optical fiber 52 is mounted on the carriage wall 47 with one end 53 adjacent the opening 49 and aligned opposite the pair of photodetectors. The other end of the optical fiber is connected to a light source (not shown). FIG. 3 is a partially shown isometric view of the droplet sensor 16 and recovery device 18 mounted on carriage 20 as viewed from the printhead looking towards the carriage 20 and cap 14 therebehind. The only difference between FIG. 2 and FIG. 3 is the orientation of the photodetector pair 48 and confronting optical fiber end 53, wherein the photodetectors and illuminating fiber ends are rotated 90°.

In FIGS. 2, 3 and 5, a linearly encoded strip 54 of suitable material, such as Mylar®, is fixedly mounted between frame members 31 and contains on one surface thereof encoding marks 55 optically detectable by a sensor (not shown) to provide the exact location of the carriage 20 and, therefore, the droplet sensor 16 and recovery device's vacuum nozzle 40 and liquid wiper 42 relative to each nozzle 15 in the printhead 10, when the printhead is positioned in the maintenance station 12. The carriage 20 has an aperture 56 through which the fixed encoded strip 54 slidingly resides. The carriage aperture accommodates the movement of the carriage relative to the encoded strip sensor, the printer controller moves the carriage 20 from one end of the array of nozzles and effects a droplet 50 ejection from each nozzle 15 when the droplet sensor 16 is aligned with the desired droplet trajectory 51, so that the correctly functioning nozzle causes a droplet to travel past the centerline between the pair of photodetectors 48. As disclosed by the above Crean et al. patent, the droplet presence is detected and the difference in the electrical signal generated by the two photodetectors determines the droplet directionality; i.e., whether the trajectory of the droplet is precisely between the two photodetectors or is more over one than the other. If droplet trajectory is along a path which the photodetectors cannot sense, then the directionality is so bad that this condition equates to a failed ejection. The required sensing circuitry (not shown) for the droplet sensor 16 is of the type fully disclosed in the Crean et al. patent and therefore is omitted from further invention by the description of this invention.

In one embodiment, the droplets 50 sensed by droplet sensor 16 are collected by absorbent pad 13 in movable cap 14 which also may be moved into contact with the printhead nozzle face to seal the nozzles and provide a humid environment to prevent the ink in the nozzles from drying out. Alternatively, the droplets sensed by the droplet sensor are collected in a closed gutter 58 attached to the backside of the droplet sensor as shown in dashed line in FIG. 5. The ink collected by the gutter drains through a tapered outlet 59 and is removed to a waste ink sump (not shown), which may have a removable absorbent member therein (not shown). To keep the optional transparent covers 78 or photodetectors 48 and optical fiber end 53, if no covers are used, from being dirtied by ink, a vacuum is placed on the gutter to pull air through the droplet sensor and to assist in directing ink in the gutter to the waste ink sump, as indicated by arrow 60, shown in dashed line.

Figure 6:
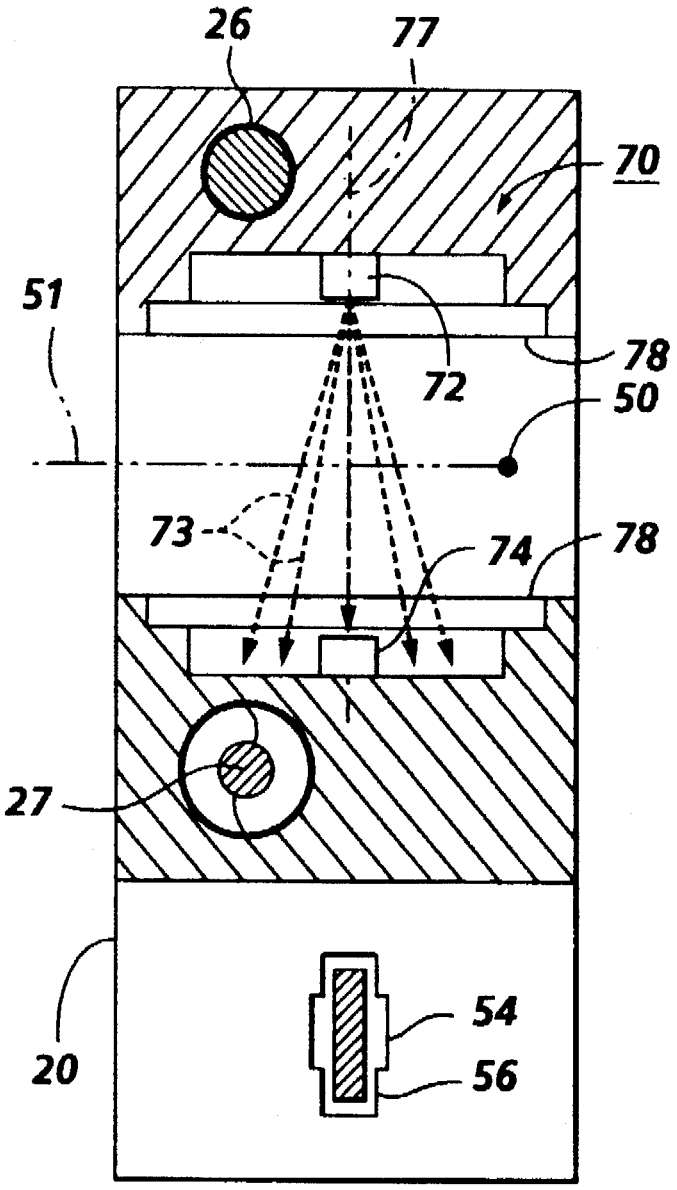
FIG. 6 is an alternate embodiment of the droplet sensor shown in FIG. 5.

FIG. 6 is an alternate embodiment of the droplet sensor 16, wherein the droplet sensor 70 of the FIG. 6 embodiment consists of a sensing region formed by an infra red (IR) light emitting diode (LED) 72 and a single lateral photodiode 74. Light rays 73 from the LED uniformly irradiates the photodiode and produces a sea of electron-hole pairs therein. Since the irradiation is uniformly distributed, equal currents will be produced at each of the diode's two electrodes 75,76 shown in FIG. 7. If a droplet 50 is fired through the center line 77 between the aligned LED 72 and photodiode 74, a shadow will be temporarily produced on the photodiode during the time of transit. This will produce a decrease in the total photocurrent, which will be related to the cross sectional area of the droplet, and a differential decrease in the currents of the two electrodes, which will be related to the lateral position. If the droplet travels through the centerline, equal dips in the two electrode currents will be observed, however if the droplet is not centered and passes closer to one electrode, the decrease in that electrode's photocurrent will be greater than the decrease at the other. By measuring the ratio of the two currents to each other, or to the total, the amount of decentering can be determined.

Figure 7:
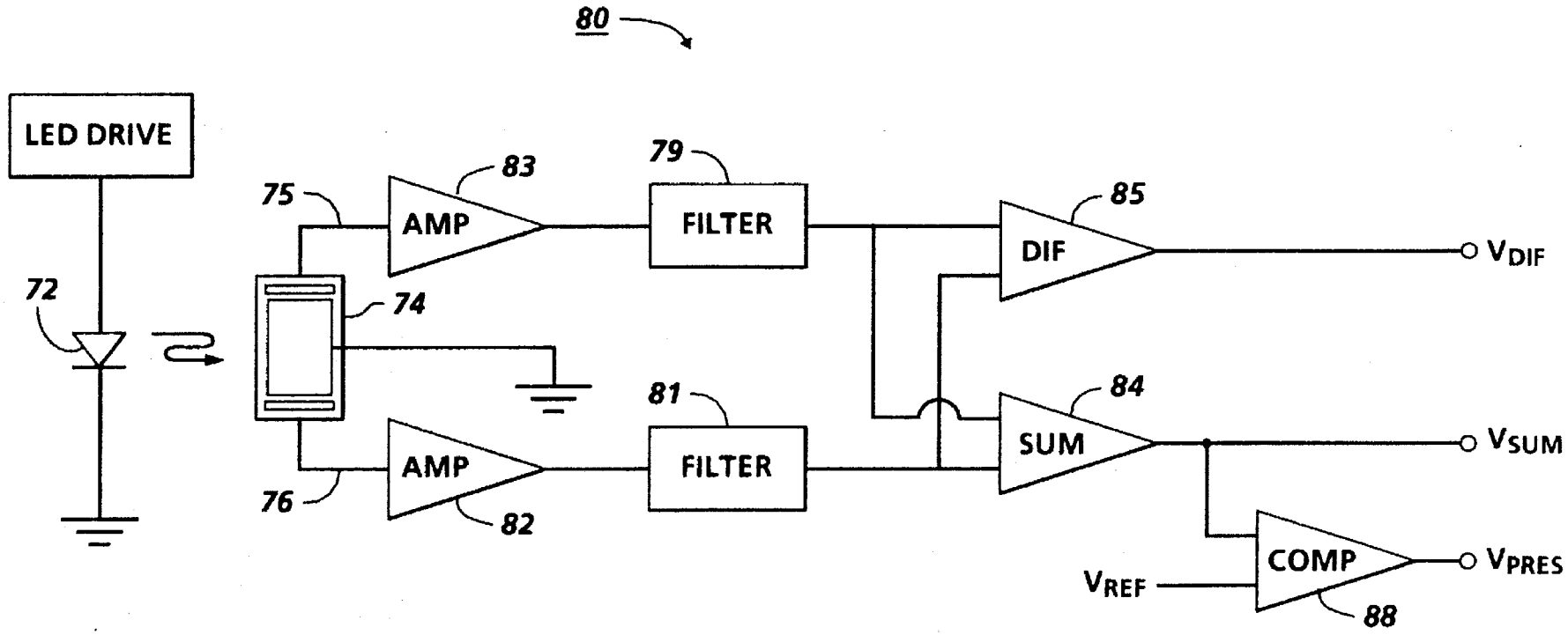
FIG. 7 is a block diagram of the circuit for the droplet sensor of FIG. 6

FIG. 7 is a block diagram of a sensor circuit 80 to accomplish this. Its three outputs are a digital droplet present signal, $V_{pres}$, an analog droplet size signal, $V_{sum}$, and an analog droplet lateral location signal, $V_{dif}$.

In the sensor circuit 80 a lateral photodiode 74 was chosen for its linearity in differential current vs. position. The photodiode has a 800×275 micron (0.800×0.275 millimeter) active area to ma relative to the steady state photocurrent. Such a photodiode may be obtained from Photonic Detectors in Chatsworth, California. The LED 72 is, for example, a standard 940 nm die from Telefunken GmBH, part # T191V-C, with nominal 2.32 milliwatt optical output at 10 Ma. The LED and photodiode are mounted opposite each other in opening 49 in the frame portion which maintains the desired separation. Optionally, transparent covers 78 are installed over the LED and photodiode to enable ready cleaning and to provide mechanical protection. The LED 72 is continuously powered at approximately 50 Ma DC, and the photocurrents are led to the sensor circuit 80 using miniature shielded coaxial cable (not shown).

Photocurrents from each electrode 75,76 are separately amplified using 2 volt per microamp transconductance amplifiers 82, 83 such as, for example, LH 00 44 C op amps which were chosen for their reported 25 uV input offset voltage matching. A difference of several mV is sufficient to completely shunt the current to the electrode with the higher potential.

The outputs from the amplifiers 82, 83 are filtered by filters 79, 81 and then summed by a summing amplifier 84 to obtain a total signal, $V_{sum}$. This yields a voltage that could be interrogated by the printer controller indicate droplet presence and droplet arrival time. This is accomplished by applying $V_{sum}$ to one input of comparator 88. If a suitable reference voltage, $V_{ref}$, is applied to the other input of the comparator 88, then a digital signal, $V_{pres}$, will be produced to indicate that a droplet 50 has passed.

$V_{sum}$ can also be used to give a measure of droplet size. A larger droplet will cast a larger shadow on photodiode 74 and will produce a larger total signal, $V_{sum}$, than a smaller one. Thus, if the peak amplitude or $V_{sum}$ is measured during the passage of a droplet through the droplet sensor 70, a measure of droplet size is obtained.

The outputs from the filters 79, 84 are also led to a difference amplifier 85, which yields a bipolar signal, $V_{dif}$, whose amplitude and sign provides a signal indicative of the lateral position of the droplet.

A typical output of the summing amplifier 84, when a single droplet 50 is propelled through the droplet sensor 16 about half way between the LED and photodiode and through the center line 77 thereof, is typically a peak signal of 250 millivolts with a signal-to-noise ration of around 25:1. The two separate signals at the output of the two amplifiers 82, 83 prior to summing for a sensed droplet are typically peak signals of between 125 and 75 millivolts with a signal-to-noise ratio of about 13:1. The peak signal from the difference amplifier 85 provides a signal, $V_{dif}$, indicative of the lateral position of the droplet as it passes between the LED and photodiode relative to the center line 77. The peak output voltage from the difference amplifier 85 typically varies between +250 millivolts and −250 millivolts and the larger the output voltage the further from centerline the droplet passes, so that a low voltage of the difference amplifier 85 of greater than −250 millivolts means the directionality of the droplet sensed is so poor that it is equivalent to plugged nozzle having no droplet ejected.

Other suitable optical sensors for sensing the presence of an ink droplet may be used, such as that disclosed in U.S. Pat. No. 5,304,814 to Markham, so long as the light path between a LED and a photodiode is at least partially interrupted by the passage of a droplet through the light path and an integrator for integrating the output signal can produce an integrated signal indicative of trajectory of the droplet relative to the centerline between an aligned LED and photodiode.

Each time the full width array printhead 10 is positioned in the maintenance station 12, the carriage 20 begins a traverse from one side of the maintenance station to the opposite side along guide rail 26 and threaded shaft 27 by the activation of motor 28 which rotates the threaded shaft. As the droplet sensor 16 is aligned with the first reach nozzle 15, as determined by the encoded strip and optical encoder (not shown), the printer controller causes the ejection of a droplet 50 by an electrical pulse to heating element 35. The light rays or path, one at least partially interrupted by the passage of the droplet and the sensor circuit, determines the presence of a droplet and its lateral position relative to the perpendicular bisector of a line between a pair of photodiodes, or in case of a single, lateral photodiode, its lateral position relative to the centerline 27 between light source or LED and the aligned photodiode. This procedure is completed for each nozzle in the printhead nozzle face and the problem nozzles are identified and stored in the memory of the printer controller as the carriage makes one traverse across the printhead nozzle face. On the return traverse by the carriage, the problem nozzles are either primed, if no droplet is ejected, or otherwise wet with a cleaning solution by the selective bulging of the meniscus 44 and then vacuum cleaned by vacuum nozzle 40. The problem nozzles alone are checked by the droplet sensor 16 to confirm that the nozzles have been recovered for subsequent printing and any nozzle not fully functional with a satisfactory directionality is again primed or cleaned during a second recovery operation. After three attempts, any nozzle which has failed to be recovered causes the printer controller to display on the printer's control panel an indication of malfunctioning nozzles and optionally the quantity of failed nozzles, together with an automatic prohibition of further printing unless manually overridden, the carriage is returned to one end of the maintenance station, and the cap 14 is sealed against the printhead nozzle face, so that a humid environment is created to prevent the drying out of the nozzles while the printer remains in a nonprinting mode.

One major advantage of priming only the nozzles which are clogged or have very poor directionality is that of saving ink which is a consumable purchased by the printer user.

Many modifications and variations are apparent from the foregoing description of the invention, and all such modifications and variations are intended to be within the scope of the present invention.

We claim:

1. A maintenance station for an ink jet printer having a printhead with a full width array of nozzles in a printhead face which confirms the satisfactory operation of each nozzle one at a time and identifies problem nozzles, so that only the problem nozzles may be serviced and recovered, comprising:

a droplet sensor and a problem nozzle recovery device being mounted on a translatable carriage for translation along and parallel to the array of nozzles in the printhead;

means for translating the carriage;

means for monitoring the location of the droplet sensor and recovery device relative to each nozzle in the array of nozzles as the carriage is being translated;

the printhead selectively ejecting at least one ink droplet through the droplet sensor from a predetermined nozzle in the array of nozzles, when said predetermined nozzle is aligned with the droplet sensor as the droplet sensor moves therepast on said carriage, the droplet sensor sensing whether a droplet was ejected or not and, if a droplet was ejected, sensing the trajectory of the droplet and determining whether the trajectory is within the limits of a predetermined directionality, the droplet sensor identifying a problem nozzle as one either not ejecting a droplet or ejecting a droplet outside the limits of a predetermined directionality during one traversal of the nozzle array; and the recovery device performing a recovery operation on each problem nozzle identified.

2. The maintenance station of claim 1, wherein the recovery device cleans the printhead face during the droplet sensing by said droplet sensor.

3. The maintenance station of claim 1, wherein the recovery device cleans the printhead face prior to checking each nozzle by the droplet sensor one at a time.

4. The maintenance station of claim 1, wherein the recovery device performs a recovery operation on each problem nozzle identified during a second traversal by the carriage after each nozzle has been checked by the droplet sensor during a first traversal by the carriage.

5. The maintenance station of claim 1, wherein each problem nozzle identified, which has also had a recovery operation performed thereon, is checked again by said droplet sensor to confirm satisfactory recovery, so that another recovery operation may be performed on identified problem nozzles that were not successfully recovered and so that successful recovery of problem nozzles is confirmed.

6. The maintenance station of claim 1, wherein the nozzle recovery device comprises:

a liquid wiper, the liquid wiper having a nozzle confronting the printhead face and spaced therefrom and containing a cleaning solution forms a meniscus at the liquid wiper nozzle;

a supply of cleaning solution connected to the liquid wiper nozzle;

means for applying pressure to the cleaning solution to cause the cleaning solution meniscus at the liquid wiper nozzle to bulge into contact with the printhead face;

at least one vacuum nozzle adjacent the liquid wiper nozzle for suction-removal of the cleaning solution and ink or other contaminants dissolved or entrained therein, the vacuum nozzle confronting the printhead face and being spaced therefrom; and a vacuum source connecting to the vacuum nozzle.

7. The maintenance station of claim 1, wherein the droplet sensor comprises:

a light source mounted in a wall of an opening in the carriage for directing light on at least one photodetector mounted in the wall of the carriage opening and confrontingly aligned with the light source to receive light therefrom;

said carriage opening parallel to the printhead face and alignable with the printhead nozzles as the carriage is translated to receive ejected droplets therethrough, whereby a droplet passing through the carriage opening temporarily blocks light received by the at least one photodetector from the light source and causes generation of a signal indicative of the passage of the droplet, the passage of a droplet along a trajectory from a printhead nozzle without interference by ink or contaminants on the printhead face providing a signal representative of a satisfactorily operating nozzle, the passage of the droplet along any other trajectory generating a signal indicating a problem nozzle for which a recovery operation by the recovery device is required;

means for storing the location of the identified problem nozzles; and means of relocating and aligning the problem nozzles with the recovery device for enabling a recovery operation thereon.

8. The maintenance station of claim 7, wherein the light source is an infra red light emitting diode and the photodetector is a single lateral photodiode with a center and having two output electrodes, and wherein the passage of a droplet between the light emitting diode and the lateral photodiode produce a differential decrease in currents of the two output electrodes if the droplet trajectory is not through the center of the lateral photodiode, so that by measuring the ratio of the currents of the two output electrodes, the amount of decentering of the droplet trajectory can be determined.

9. A method of maintenance of a full width array printhead in an ink jet printer, the printhead having a linear array of nozzles in a nozzle face of the printhead, the maintenance method comprising the steps of:

translating a translatable carriage parallel to the array of nozzles in the printhead, the carriage having mounted thereon a droplet sensor and a recovery device;

monitoring the location of the droplet sensor and recovery device relative to the nozzles as the carriage is being translated;

selectively ejecting a droplet from each nozzle when the droplet sensor reaches a predetermined position in alignment with the nozzle from which a droplet is to be ejected;

sensing a droplet ejected from each nozzle in the array of nozzles one nozzle at a time by the droplet sensor mounted on said translatable carriage;

determining whether a droplet was ejected by the droplet sensor and, if a droplet was ejected, determining whether the trajectory is within the limits of a predetermined directionality of trajectory followed by the elected droplet;

identifying a problem nozzle in the nozzle array by detecting either the absence of an ejected droplet or a deviation of the droplet trajectory outside the limits of a predetermined directionality; on a subsequent translation of the carriage, performing a predetermined recovery operation on each identified problem nozzle, and sensing a droplet ejected from each problem nozzle for which a recovery operation was performed to confirm full recovery and re-performing a predetermined recovery operation not fully recovered.

* * * * *